US007509772B2

(12) United States Patent
Ohta et al.

(10) Patent No.: US 7,509,772 B2
(45) Date of Patent: Mar. 31, 2009

(54) VEHICLE DOOR OPENING AND CLOSING APPARATUS

(75) Inventors: Takayuki Ohta, Kariya (JP); Takaya Aiyama, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 523 days.

(21) Appl. No.: 11/232,877

(22) Filed: Sep. 23, 2005

(65) Prior Publication Data

US 2006/0066147 A1 Mar. 30, 2006

(30) Foreign Application Priority Data

Sep. 24, 2004 (JP) ..... 2004-277098

(51) Int. Cl.
*E05F 15/10* (2006.01)

(52) U.S. Cl. ..... 49/334; 49/28; 49/140

(58) Field of Classification Search ..... 49/28, 49/139, 140, 334, 360; 318/286, 446, 466–469; 296/56

See application file for complete search history.

(56) References Cited

U.S. PATENT DOCUMENTS 6,198,242 B1 * 3/2001 Yokomori et al. ..... 318/445
6,452,353 B1 * 9/2002 Calamatas ..... 318/466
6,729,071 B1 * 5/2004 Kawanobe et al. ..... 49/360
2003/0025469 A1 * 2/2003 Zhou et al. ..... 318/34

FOREIGN PATENT DOCUMENTS

JP 06-144000 5/1994
JP 09-328961 12/1997
JP 2000-356069 12/2000
JP 2002242533 A * 8/2002

* cited by examiner

*Primary Examiner*—Katherine W Mitchell
*Assistant Examiner*—Michael J Keller
(74) *Attorney, Agent, or Firm*—Buchanan Ingersoll & Rooney PC

(57) ABSTRACT

A controller controls, based upon a manual operation signal from a first operating means and the automatic operation signal from a second operating means, a driving of a driving power source for generating a driving force for an opening/closing operation of a vehicle door. The controller switches control for driving the driving power source. An automatic operation mode is selected when the automatic operation signal is inputted to the controller, in which the driving power source is driven to output a predetermined first driving output value. A manual operation mode is selected when the manual operation signal is inputted to the controller in which the driving power source is driven to output a second driving output value which is higher than the first driving output value.

14 Claims, 6 Drawing Sheets

VEHICLE DOOR OPENING AND CLOSING APPARATUS

CROSS REFERENCE TO RELATED APPLICATIONS

This application is based on and claims priority under 35 U.S.C. §119 with respect to Japanese Patent Application 2004-277098, filed on Sep. 24, 2004, the entire content of which is incorporated herein by reference.

FIELD OF THE INVENTION

This invention generally relates to a vehicle door opening and closing apparatus which operates a vehicle door to open and close an opening defined in a vehicle body such as a vehicle side door and a back door (tail gate)

BACKGROUND

Conventionally, as is disclosed in JP1994(06)-144000A, this type of vehicle door opening and closing apparatus is provided with a driving power source configured to generate a driving force relevant to an opening/closing movement of a vehicle door, an opening/closing mechanism for operating a vehicle door by a driving force of the driving power source in such a manner that an opening defined in a vehicle body is opened and closed, an operating means for outputting an operation signal in response to its operation, and a controlling means for controlling, on the basis of the operation signal, a driving of the driving power source. This apparatus is further provided with an overload-detecting means for detecting a load applied to the vehicle door. When the controlling means determines on the basis of a signal from the overload-detecting means that the vehicle door has been subjected to an overload, the controlling means implements a control by which a driving of the driving power source is ceased. This apparatus is still further provided with a vehicle door operation intention-detecting means for detecting an intention of a user to manually operate the vehicle door. When the controlling means has determined on the basis of a signal from the overload-detecting means that the vehicle door has been subjected to an overload, if the controlling means determines on the basis of a signal from the vehicle door operation intension-detecting means that a user intends to manually operate the vehicle door, the controlling means switches an actually running mode to a manual operation mode.

According to the above described vehicle door opening and closing apparatus, however, when a load being applied to the vehicle door is, for example, too great to manually open or close the vehicle door, the controlling means ceases driving the driving power source in response to a signal from the overload-detecting means. Therefore, it is not possible to open and close the vehicle door by use of a driving force of the driving power source, and is further not possible to open and close the vehicle door even manually. In such a case, there is a danger of the convenience, which is required upon opening and closing the vehicle door, of being deteriorated. Further, when a signal from the overload-detecting means is employed to control an obstacle entrapment detection while the vehicle door is being opened and closed, normally, the driving power source is controlled to generate an output value at a low level so that load applied to an entrapped obstacle can be restrained. Accordingly, it is obvious that convenience above described would be damaged.

The present invention has been made in view of the above circumstances, and provides a vehicle door opening and closing apparatus which is capable of assuring safety of an opening/closing operation of a vehicle door, and of enhancing convenience thereof.

SUMMARY OF THE INVENTION

According to an aspect of the present invention, a vehicle door opening and closing apparatus includes: a driving power source configured to generate a driving force relevant to an opening operation, and a closing operation, of a vehicle door; an opening-closing mechanism capable of implementing the opening operation, and the closing operation, of the vehicle door by the driving force of the driving power source; a first operating means for continuously outputting a manual operation signal, confined to times when the first operating means is continuously being operated; a second operating means for outputting an automatic operation signal irrespective of whether or not the second operating means is continuously operated, once the second operating means is put into operation; and a controlling means for controlling, on the basis of the manual operation signal and the automatic operation signal, a driving of the driving power source. The controlling means is capable of switching control for driving the driving power source in such a manner that an automatic operation mode is selected at a time that the automatic operation signal is inputted to the controlling means, the automatic operation mode in which the driving power source is driven to output a predetermined first driving output value, and a manual operation mode is selected at a time that the manual operation signal is inputted to the controlling means, the manual operation mode in which the driving power source is driven to output a second driving output value which is higher than the first driving output value.

It is preferable that the vehicle door opening and closing apparatus further includes a detecting means for outputting a signal representing an operating state of the vehicle door. The controlling means computes, on the basis of the signal from the detecting means, an opening speed, and a closing speed, of the vehicle door, the controlling means implements a discontinuation control during the automatic operation mode, the discontinuation control by which the driving of the driving power source is discontinued at an event that the opening speed, or the closing speed, of the vehicle door is decelerated beyond a predetermined speed value, and the controlling means prohibits the discontinuation control for the duration of the manual operation mode.

It is further preferable that the controlling means implements a normal driving control by which driving of the driving power source is controlled in such a manner that the driving power source outputs a third driving output value during the manual operation mode prior to implementing the discontinuation control, and implements an urgent driving control by which driving of the driving power source is controlled in such a manner that the driving power source outputs a fourth driving output value, which is higher than the third driving output value, during the manual operation mode after implementing the discontinuation control.

It is still further preferable that the first driving output value is quantitatively equivalent to the third driving output value, and the second driving output value is quantitatively equivalent to the fourth driving output value.

It is still further preferable that the first driving output value is lower than the third driving output value.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

An embodiment of the present invention will be described hereinbelow in detail with reference to the accompanying drawings.

Figure 1:
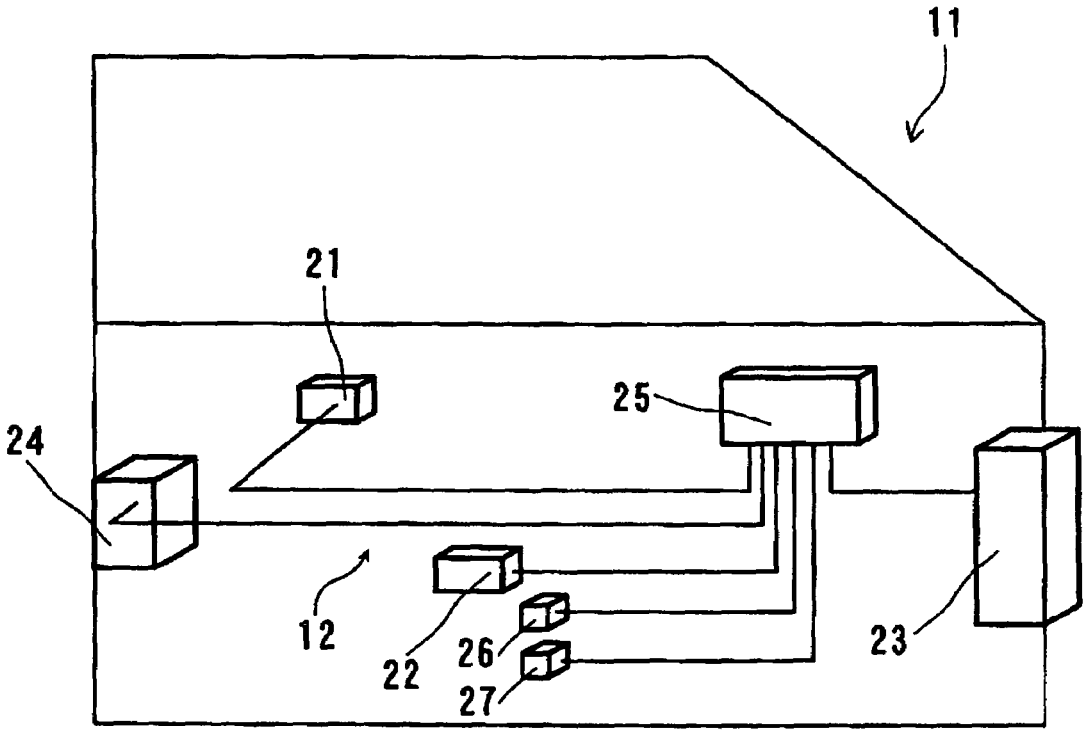
FIG. 1 is a block view of a vehicle door on which a vehicle door opening and closing apparatus according to an embodiment of the present invention is mounted.

As is illustrated in FIG. 1, a swing door 11 as a vehicle door is supported by use of a known hinge (not illustrated) and is operated to open and close a door opening defined in a vehicle side body. A vehicle door opening and closing apparatus 12 is mounted on the swing door 11, an apparatus 12 which controls opening operations, and closing operations, of the swing door 11.

The vehicle door opening and closing apparatus 12 is provided with an outside automatic operation switch 21 (second operating means) being positioned on the exterior of the swing door 11, an inside automatic operation switch 22 (the second operating means) being positioned on the interior of the swing door 11, an inside manual opening operation switch 26 (first operating means), an inside manual closing operation switch 27 (the first operating means), a door opening and closing operation-driving unit 23, a latch driving unit 24, and a controller 25. The door opening and closing operation-driving unit 23 will be described in detail later. The latch-driving unit 24 holds the swing door 11 relative to a vehicle side body at a fully closed state, in which the door opening is fully closed, or at a half-closed state, in which the door opening is half closed. The controller 25 is electrically connected to all these components 21, 22, 23, 24, 26, and 27.

The outside automatic operation switch 21 outputs an automatic operation signal irrespective of whether or not the outside automatic operation switch 21 is continuously operated, once the outside automatic operation switch 21 is put into operation. The outside automatic operation switch 21 is operated outside the vehicle at a time that an automatic opening/closing operation of the swing door 1 is implemented by the door opening and closing operation-driving unit 23. Likewise, the inside automatic operation switch 22 outputs an automatic operation signal irrespective of whether or not the inside automatic operation switch 22 is subsequently continuously operated, once the inside automatic operation switch 22 is put into operation. The inside automatic operation switch 22 is operated inside the vehicle at a time that an automatic opening/closing operation of the swing door 11 is implemented by the door opening and closing operation-driving unit 23. Hereinafter, the automatic opening/closing operation of the swing door 11 includes an operation from the fully closed state to the fully open state, and an operation from the fully open state to the fully closed state. The inside manual opening operation switch 26 continuously outputs a manual operation signal, confined to times when the inside manual opening operation switch 26 is continuously being operated. The inside manual opening operation switch 26 is operated inside the vehicle at a time that a manual opening operation of the swing door 11 is implemented by the door opening and closing operation driving unit 23. Likewise, the inside manual closing operation switch 27 continuously outputs a manual operation signal, confined to times when the inside manual closing operation switch 27 is continuously being operated. The inside manual closing operation switch 27 is operated inside the vehicle at a time that a manual closing operation of the swing door 11 is implemented by the door opening and closing driving unit 23.

The latch-driving unit 24 includes a latch engageable with a striker fixed at the vehicle side body, and a pole engageable with the latch during a door latched condition in which the striker is being engaged with the latch. The latch-driving unit 24 further includes a known structure which is capable of establishing a door latched condition, a door half-latched condition, and a door unlatched condition. The latch-driving unit 24 still further includes an actuator that is operated for the purpose of switching the above-described door latched/unlatched/half-latched condition. The controller 25 controls a driving of the actuator of the latch-driving unit 24, wherein the swing door 11 is switched from the door latched condition to the door unlatched condition when the swing door 11 is to be opened, on the other hand, the swing door 11 is switched from the door half latched condition to the door latched condition when the swing door 11 is to be closed.

The door opening and closing driving unit 23 is attached to the swing door 11, and moves a lever 14 back and forth, of which one end is connected to the swing door 11, and the other end is connected to a pillar 13, wherein the swing door 11 is rotated with the hinge as a fulcrum, and the door opening is closed or opened.

When the swing door 11 has been closed, in response to an operation, of the outside automatic operation switch 21, or of the inside automatic operation switch 22, the controller 25 as a controlling means controls the latch-driving unit 24 and switches the swing door 11 from the door latched condition to the door unlatched condition. The controller 25 in succession controls the door opening and closing-driving unit 23 so as to rotate the swing door 11, wherein the door opening is opened. When the swing door 11 has been open, in response to an operation, of the outside automatic operation switch 21, or of the inside automatic operation switch 22, the controller 25 controls the door opening and closing-driving unit 23 and rotates the swing door 11. The controller 25 in succession controls the latch-driving unit 24, wherein the swing door 11 is switched to the door latched condition so as to close the door opening.

Next, described below is an operation of the door opening and closing-driving unit 23.

Figure 2:
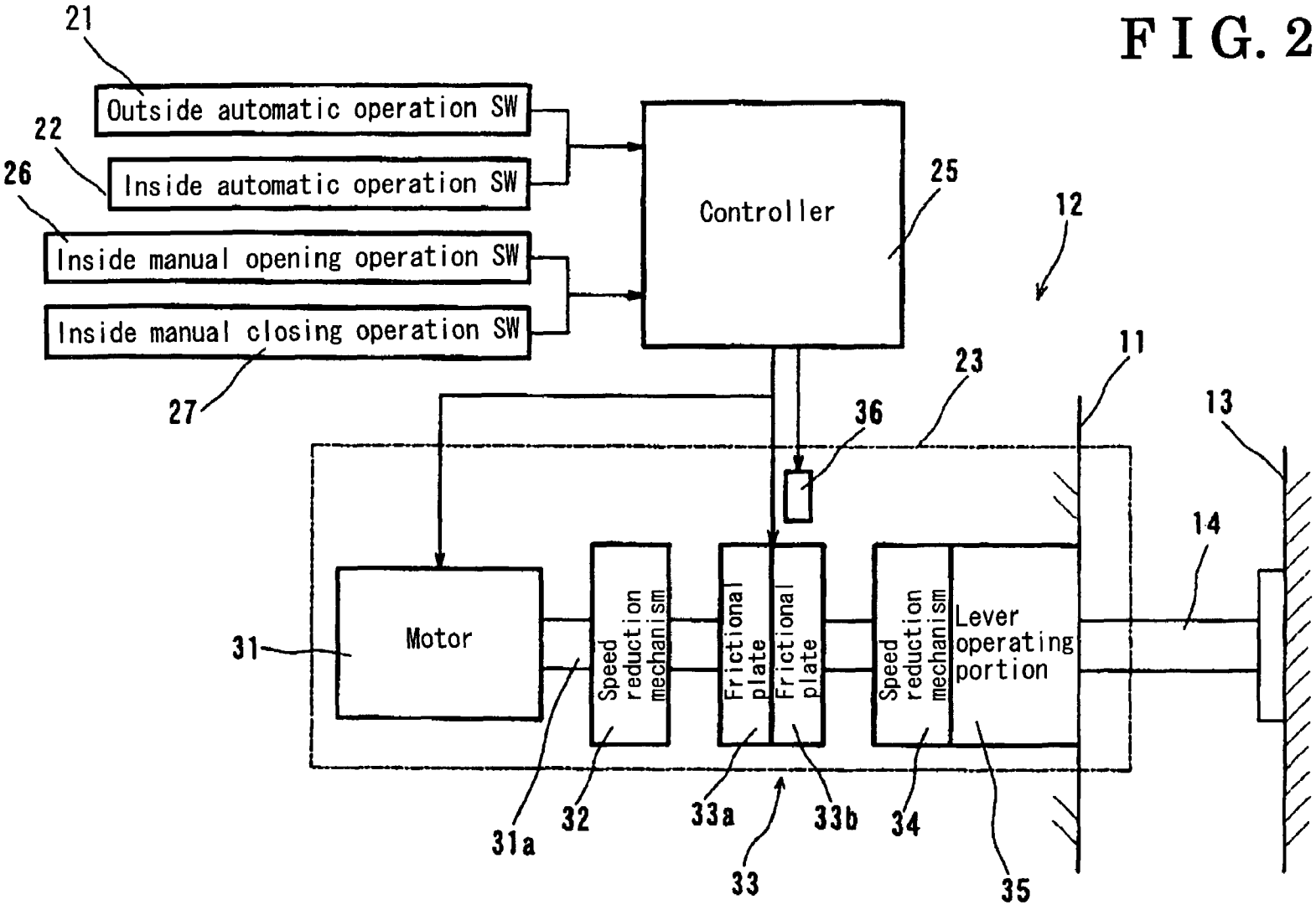
FIG. 2 is a block view schematically illustrating the vehicle door opening and closing apparatus.

As is illustrated in FIG. 2, the door opening and closing-driving unit 23 is configured with a door driving motor 31 as a driving power source, a first speed reduction mechanism 32, an electromagnetic clutch 33 as a power transmitting mechanism, a second speed reduction mechanism 34, and a lever-operating portion 35 as an operating mechanism.

The door driving motor 31 operates in response to a drive signal from the controller 25, and rotates a rotational shaft 31*a* in a normal rotational direction or in a reverse rotational direction. The electromagnetic clutch 33 is provided with two frictional plates 33*a* and 33*b;* the frictional plate 33*a* as a force transmitting member and the frictional plate 33*b* as a force-receiving member. The electromagnetic clutch 33 operates in response to an operation signal from the controller 25, and switches its condition between a joined condition, in which the frictional plate 33*a* is frictionally engaged with the frictional plate 33*b*, and a cutoff condition, in which the frictional plate 33*a* is disengaged from the frictional plate 33*b*. During the joined condition of the electromagnetic clutch 33, rotation of the door driving motor 31 is transmitted to the lever-operating portion 35. The lever operating portion 35, which is connected to the lever 14, converts rotation of the door driving motor 31, which is transmitted thereto via the electromagnetic clutch 33, to a linear motion, wherein the lever 14 is moved back and forth. The first speed reduction mechanism 32 is employed to interconnect the rotational shaft 31*a* of the door driving motor 31 and the frictional plate 33*a* of the electromagnetic clutch 33. The first speed reduction mechanism 32 is capable of decelerating rotation of the rotational shaft 31*a* at a predetermined speed reduction ratio, and is capable of transmitting the decelerated rotation of the rotational shaft 31*a* to the frictional plate 33*a*. The second speed reduction mechanism 34 is employed to interconnect the frictional plate 33*b* of the electromagnetic clutch 33 and the lever-operating portion 35. The second speed reduction mechanism 34 is capable of decelerating rotation of the frictional plate 33*b* at a predetermined speed reduction ratio, and is capable of transmitting the decelerated rotation of the frictional plate 33*b* to the lever-operating portion 35.

Figure 3:
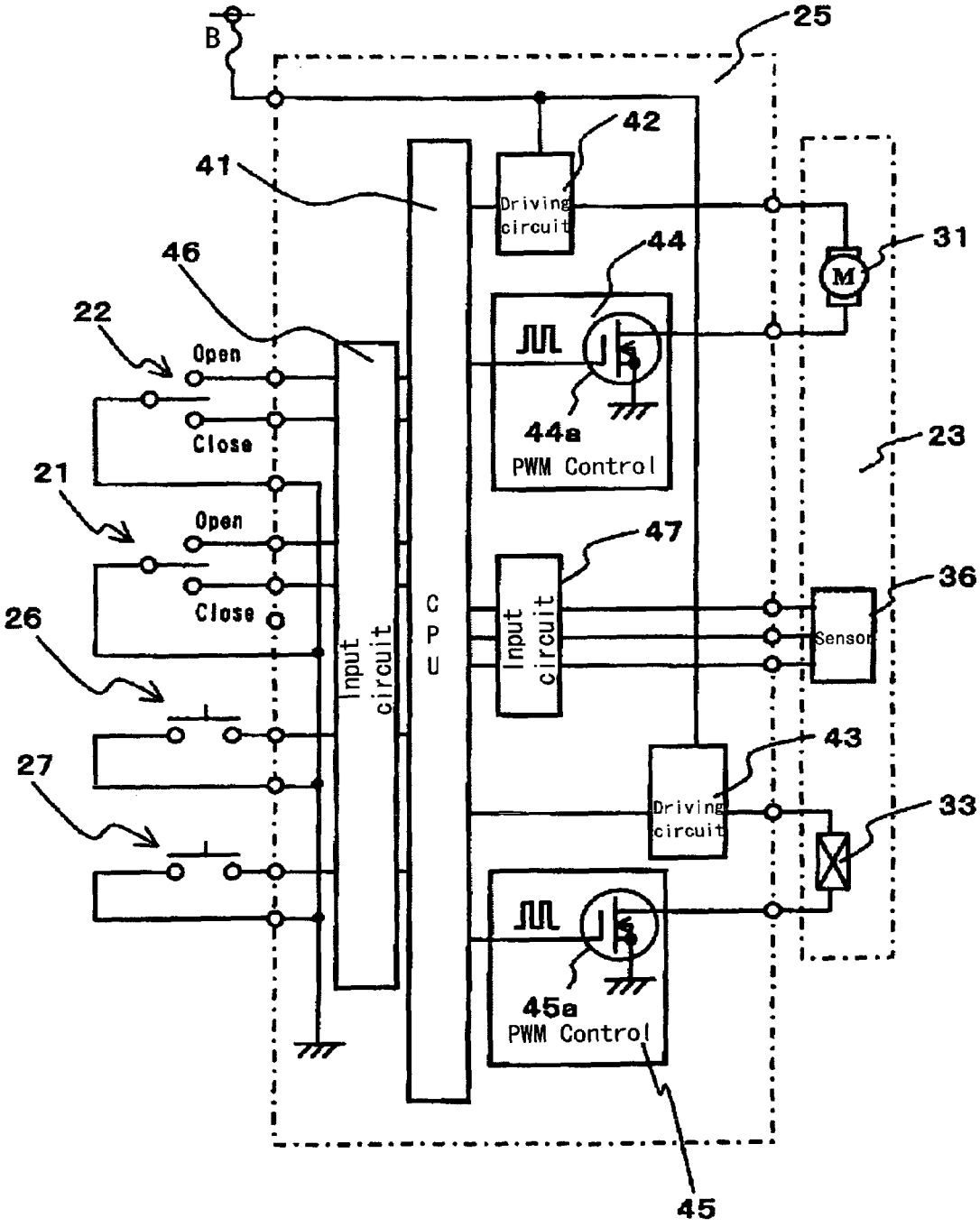
FIG. 3 is a circuit view illustrating a controller for controlling the vehicle door opening and closing apparatus.

As is illustrated in FIGS. 2 and 3, a pulse sensor 36 as a detecting means is preferably positioned between the electromagnetic clutch 33 and the second speed reduction mechanism 34. The pulse sensor 36 outputs a signal corresponding to rotation transmitted between the electromagnetic clutch 33 and the second speed reduction mechanism 34, or a signal corresponding to a rotational condition transmitted to the electromagnetic clutch 33 from the first speed reduction mechanism 32. A Hall element is one of the examples for the pulse sensor 36, as a non-limiting example. The Hall element is mounted so as to output, to the controller 25, a predetermined pulse signal corresponding to variation in magnetic flux of a magnet attached at the frictional plate 33*b*. The controller 25 counts the number of pulse signals and computes a rotational number (rotational speed) of the frictional plate 33*b*.

Next, described below is a structure of the controller 25.

As is illustrated in FIG. 3, the controller 25 incorporates, therein, a CPU (central processing unit) 41, a motor driving circuit 42, a clutch driving circuit 43, and a pulse width modulation circuit 44.

The CPU 41 is electrically connected, via an input circuit 46, to the outside automatic operation switch 21, the inside automatic operation switch 22, an inside manual opening operation switch 26, and an inside manual closing operation switch 27. The CPU 41 is able to compute, on the basis of an automatic operation signal and a manual operation signal therefrom, the presence or absence of an opening operation, and a closing operation, of the swing door 11. The CPU 41 is further electrically connected to the pulse sensor 36 via an input circuit 47. The CPU 41 is able to count the number of pulse signals outputted from the pulse sensor 36 and to compute the rotational number (rotational speed) of the frictional plate 33*b*. The CPU 41 computes, on the basis of the pulse signals from the pulse sensor 36, a position of the swing door 11 being moved, and further computes an opening/closing speed of the swing door 11.

The motor driving circuit 42 is electrically connected to the CPU 41 and is applied with a battery voltage from a battery B illustrated in FIG. 3. In response to a driving signal fed from the CPU 41 to the motor driving circuit 42, the motor driving circuit 42 supplies, by use of a polarity corresponding to the driving signal, an electric power to a door driving motor 31 of the door opening and closing-driving unit 23.

The clutch driving circuit 43 is electrically connected to the CPU 41 and is applied with a battery voltage from the battery B illustrated in FIG. 3. In response to an operation signal fed from the CPU 41 to the clutch driving circuit 43, the clutch driving circuit 43 supplies an operation electric power, or ceases the supply, for the purpose of operating the electromagnetic clutch 33 of the door opening and closing-driving unit 23.

The pulse width modulation circuit 44 is interposed between the CPU 41 and the door driving motor 31 in such a manner that the CPU 41 is electrically connected to the door driving motor 31 via the pulse width modulation circuit 44. The pulse width modulation circuit 44 is able to modulate a value of electric power to be supplied to the door driving motor 31. Likewise, a pulse width modulation circuit 45 is interposed between the CPU 41 and the electromagnetic clutch 33 in such a manner that the CPU 41 is electrically connected to the electromagnetic clutch 33 via the pulse width modulation circuit 45. The pulse width modulation circuit 45 is able to modulate a value of electric power to be supplied to the electromagnetic clutch 33. The CPU 41 alters a pulse width of a control signal fed to the pulse width modulation circuit 44, in response to a driving condition of the door driving motor 31 to be controlled. Likewise, the CPU 41 alters a pulse width of a control signal fed to the pulse width modulation circuit 45, in response to a joined condition of the electromagnetic clutch 33 to be controlled. The pulse width modulation circuits 44 and 45 are respectively provided with switching elements 44*a* and 45*a* to be turned on and off in response to the control signals. For example, an N-channel MOS transistor can be employed as the switching element as a non-limiting example. The pulse width modulation circuit 44 is capable of modulating, in accordance with a ratio of turning the switching element 44*a* on and off, a mean value of an electric current supplied to the door driving motor 31. That is, the CPU 41 controls a driving output (output torque) of the door driving motor 31 by means of a so-called PWM control by the pulse width modulation circuit 44. Likewise, the pulse width modulation circuit 45 is capable of modulating, in accordance with a ratio of turning the switching element 45*a* on and off, a mean value of an electric current supplied to the electromagnetic clutch 33. That is, the CPU 41 controls a clutch output of the electromagnetic clutch 33 (a frictional engagement condition between the frictional plates 33*a* and 33*b*) by means of a so-called PWM control by the pulse width modulation circuit 45. The CPU 41 outputs a driving signal to supply a driving electric power to the door driving motor 31, and outputs a control signal to the pulse width modulation circuit 44 to turn the switching element 44*a* on and off. As a result, the door driving motor 31 is supplied with a mean electric current in response to an intermittent on operation of the switching element 44*a*, wherein the door driving motor 31 is activated. Regarding the electromagnetic clutch 33, during a discontinuation state in which an operation electric power is not supplied to the electromagnetic clutch 33, the electromagnetic clutch 33 is at the cutoff condition in which the frictional plates 33*a* and 33*b* are disengaged from each other. These frictional plates 33*a* and 33*b* enter into an engaged condition in response to a value of a driving electric power to be supplied from the motor driving circuit 42. Therefore, the CPU 41 outputs an operation stop signal so as not to supply an operation electric power to the electromagnetic clutch 33, wherein the electromagnetic clutch 33 enters into the cutoff condition. The CPU 41 outputs an-operation signal to supply an operation electric power to the electromagnetic clutch 33, and outputs a control signal to the pulse width modulation circuit 45 to turn the switching element 45*a* on and off. As a result, the electromagnetic clutch 33 is supplied with a mean electric current in response to an intermittent on operation of the switching element 45*a*, wherein the electromagnetic clutch 33 enters into the joined condition.

Figure 4:
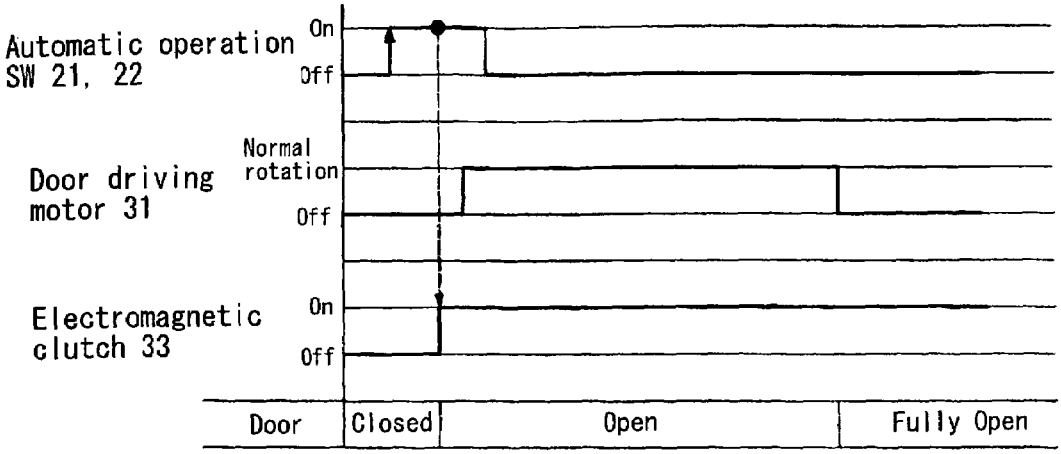
FIG. 4 is a timing chart for explaining operation of the controller during an automatic operation mode.
Figure 5:
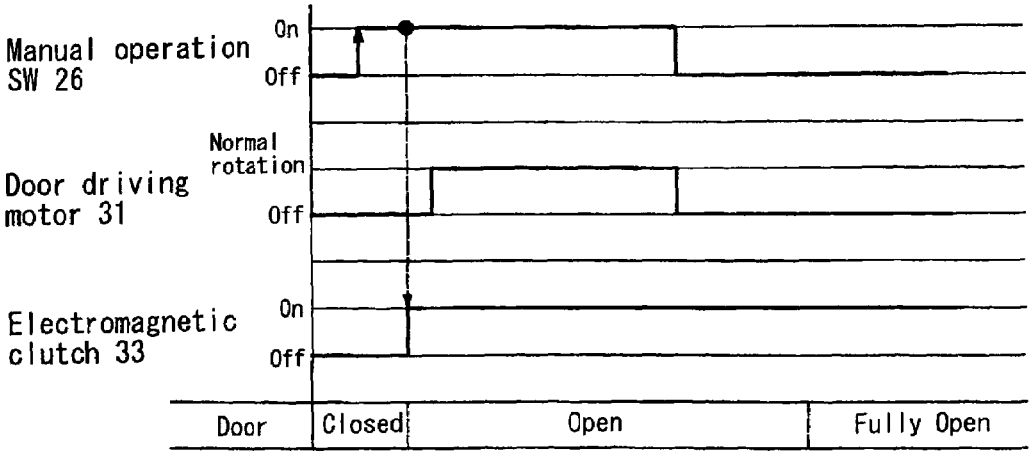
FIG. 5 is another timing chart for explaining operation of the controller during a manual operation mode.

Next, described below is an operation of the controller 25, especially an operation relevant to the door opening and closing-driving unit 23 with reference to timing charts illustrated in FIGS. 4 and 5.

Described below is an automatic operation mode implemented by the vehicle opening and closing apparatus according to the embodiment of the present invention.

When the outside automatic operation switch 21 or the inside automatic operation switch 22 is operated during the fully closed state of the swing door 11, an operation signal from the outside automatic operation switch 21 or the inside automatic operation switch 22 is inputted to the controller 25. In order to open the swing door 11 by use of a driving force of the door driving motor 31, the controller 25 outputs a driving signal to the motor driving circuit 42 and outputs an operation signal to the clutch driving circuit 43, thereby driving the door driving motor 31 as well as operating the electromagnetic clutch 33. Because a driving signal to the motor driving circuit 42 is employed to rotate the door driving motor 31 in a normal direction, the lever 14 is moved forth or pushed by the lever operating portion 35, wherein the swing door 11 is rotated in a direction to open the door opening. When a driving signal sent to the motor driving circuit 42 includes a component to move back or pull the lever 14, the swing door 11 is rotated in a reverse direction to close the door opening. In such circumstances, a driving signal sent to the motor driving circuit 42 is employed for the purpose of controlling the pulse width modulation circuit 44 to modulate or alter a value of electric power to be supplied to the door driving motor 31 in such a manner that a driving torque as a driving output is controlled at a predetermined value (a first torque value). On the other hand, an operation signal sent to the clutch driving circuit 43 is employed for the purpose of controlling the pulse width modulation circuit 45 to modulate or alter a value of electric power to be supplied to the electromagnetic clutch 33 in such a manner that a clutch output is controlled at a predetermined value (a first output value) which corresponds to an opening/closing position, and/or an opening/closing speed, of the swing door 11. Here, the predetermined value of the clutch output is set in such a manner that a frictional engagement between the frictional plates 33*a* and 33*b* can be always assured at the essentially minimum extent for transmitting rotation of the door driving motor 31 to the lever operating portion 35. The controller 25 then detects, on the basis of a pulse signal from the pulse sensor 36, the swing door 11 positioned at the fully opened position. In this case, the controller 25 outputs a discontinuation signal to the motor driving circuit 42 and stops driving the door driving motor 31. As a result, the opening operation of the swing door 11, which is implemented to open the door opening by the driving force of the door driving motor 31, is stopped, and a clutch output is controlled at a predetermined value (a second output value). The predetermined value of the clutch output at this point is controlled at an adequate value for holding the swing door 11 at a predetermined holding load. This predetermined holding load corresponds to a load of which level is adequate to cope with a natural force such as a wind blowing to the swing door 11, a force that rotates the swing door 11 in an opening or closing direction at an event that a vehicle has been parked on a slope, and so on. When the swing door 11 is to be closed by use of a driving force of the door driving motor 31 while the swing door 11 is being positioned at the fully open condition, it is preferable that the door driving motor 31 is driven in a reverse rotational direction by operating the outside or inside automatic operation switch 21 or 22. The operation of the electromagnetic clutch 33 and so on is the same as described above.

Described below is a manual operation mode implemented by the vehicle opening and closing apparatus according to the embodiment of the present invention.

When the inside manual opening operation switch 26 is operated, an operation signal from the inside manual opening operation switch 26 is inputted to the controller 25. In order to open the swing door 11 by use of a driving force of the door driving motor 31, the controller 25 outputs a driving signal to the motor driving circuit 42 and outputs an operation signal to the clutch driving circuit 43, thereby driving the door driving motor 31 as well as operating the electromagnetic clutch 33. Because a driving signal to the motor driving circuit 42 is employed to rotate the door driving motor 31 in a normal direction, the lever 14 is moved forth or pushed by the lever operating portion 35, wherein the swing door 11 is rotated in a direction to open the door opening. When a driving signal sent to the motor driving circuit 42 includes a component to move back or pull the lever 14, the swing door 11 is rotated in a reverse direction to close the door opening. In such circumstances, a driving signal sent to the motor driving circuit 42 is employed for the purpose of controlling the pulse width modulation circuit 44 to modulate or alter a value of electric power to be supplied to the door driving motor 31 in such a manner that a driving output, i.e., a driving torque, is controlled at a predetermined value (a third torque value or a fourth torque value) which is higher than the first torque value. On the other hand, an operation signal sent to the clutch driving circuit 43 is employed for the purpose of controlling the pulse width modulation circuit 45 to modulate or alter a value of electric power to be supplied to the electromagnetic clutch 33 in such a manner that a clutch output is controlled at the highest value. The fourth torque value is a driving force that the door driving motor 31 is capable of outputting at the maximum level. The third torque value is lower than the fourth torque value, and but is higher than the first torque value. When the controller 25 is no longer inputted with the operation signal from the inside manual opening operation switch 26, the controller 25 outputs a discontinuation signal to the motor driving circuit 42 and stops driving the door driving motor 31. As a result, the opening operation of the swing door 11, which is implemented to open the door opening by the driving force of the door driving motor 31, is stopped, and a clutch output is controlled at the predetermined value (the second output value,). Likewise as an operation for stopping the opening operation of the swing door 11 during the automatic operation mode, the predetermined value of the clutch output at this point is controlled at an adequate value for holding the swing door 11 at a predetermined holding load. When the swing door 11 is to be closed by use of a driving force of the door driving motor 31, it is preferable that the door driving motor 31 is driven in a reverse rotational direction by operating the inside manual closing operation switch 27. The operation of the electromagnetic clutch 33 and so on is the same as described above.

Next, described below is control of the electromagnetic clutch 33 by the controller 25 with reference to flowcharts illustrated in FIGS. 6 and 7.

Figure 6:
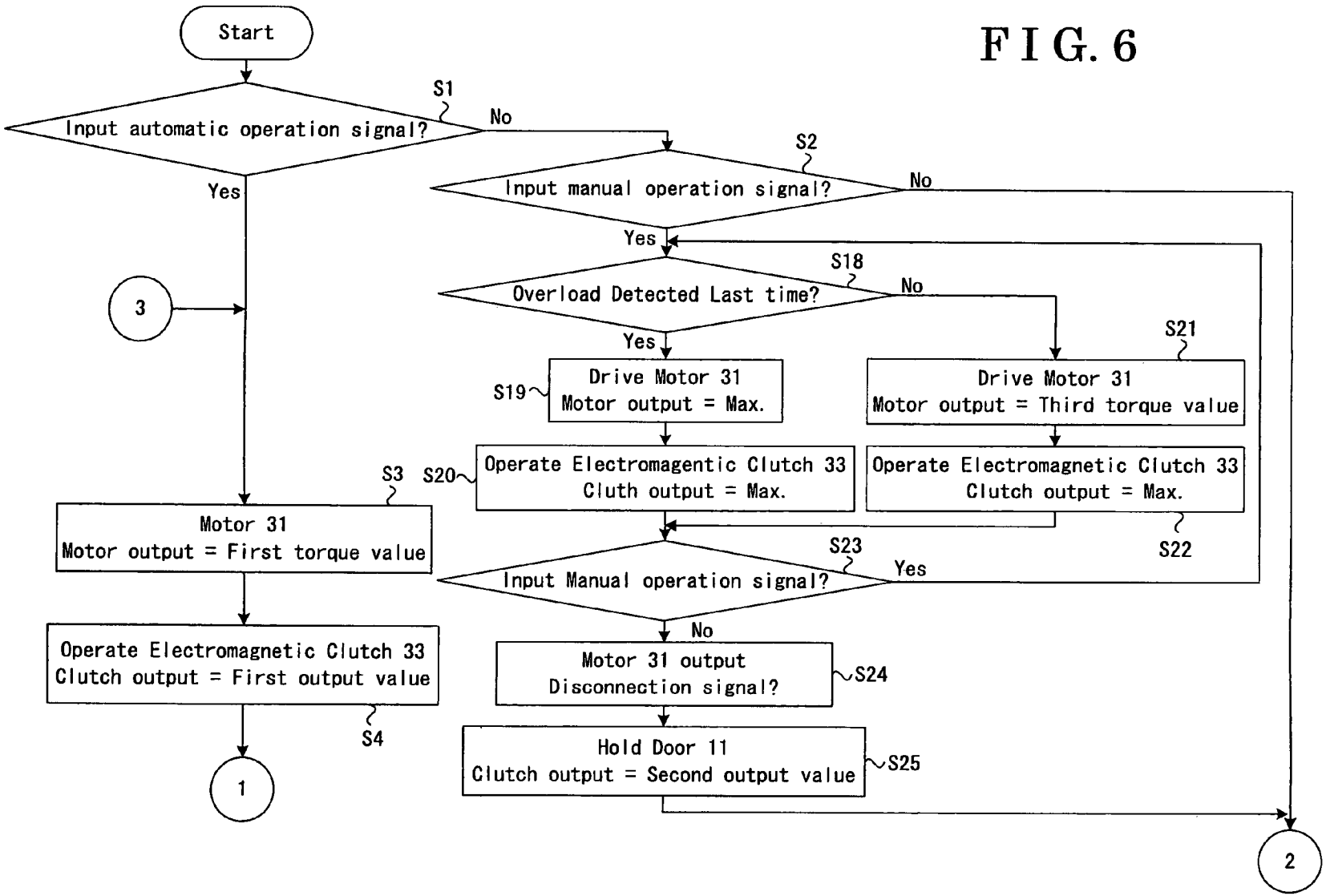
FIG. 6 is a flowchart for explaining an operation of the controller according to the embodiment of the present invention.
Figure 7:
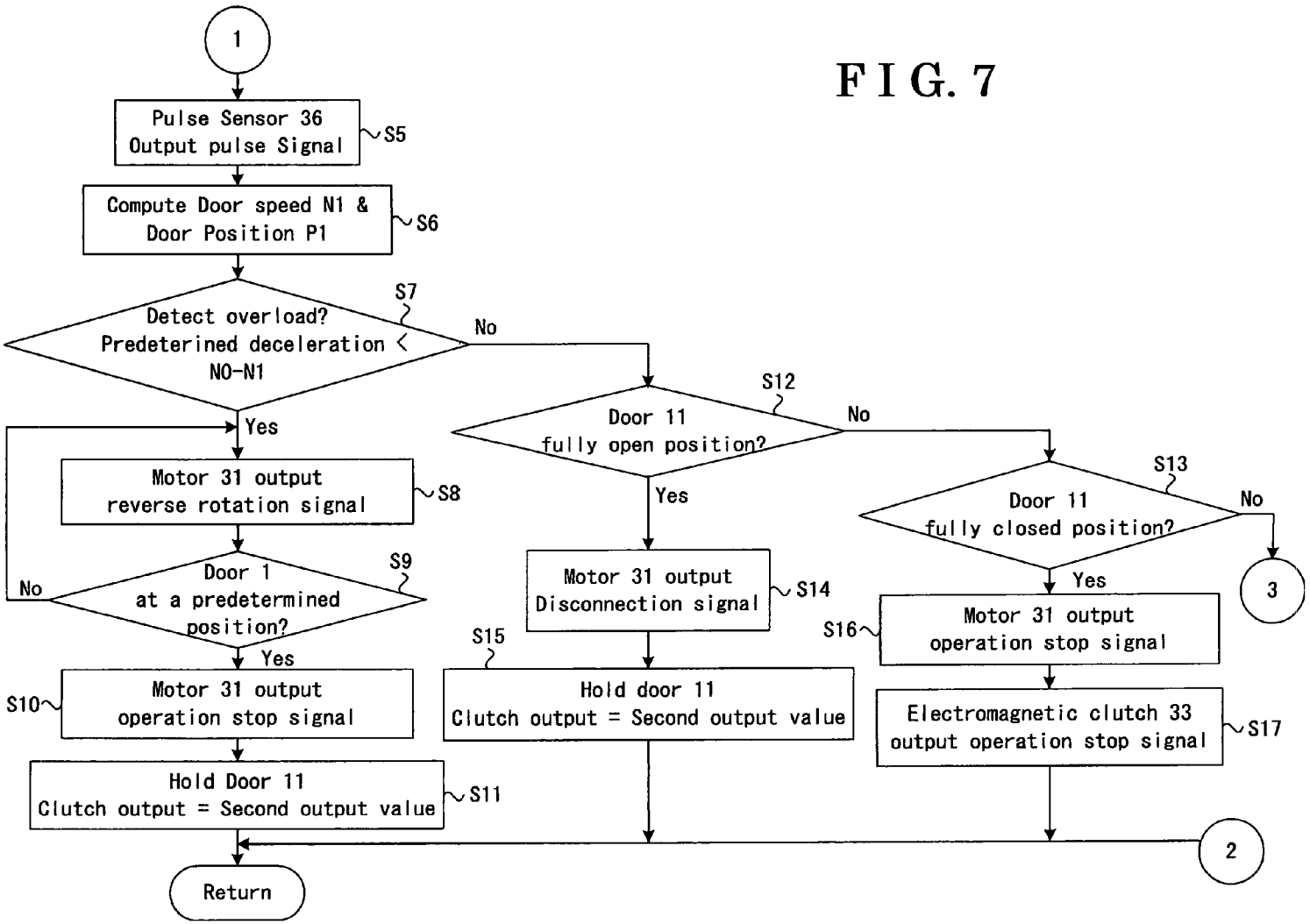
FIG. 7 is a flowchart for explaining an operation of the controller following the flowchart in FIG. 6.

At step S1 in FIG. 6, the CPU 41 determines on the basis of an automatic operation signal whether either the outside automatic operation switch 21 or the inside automatic operation switch 22 was put into operation. At step S2 in FIG. 6, the CPU 41 determines on the basis of a manual operation signal whether either the inside manual opening operation switch 26 or the inside manual closing operation switch 27 is being operated.

When the CPU 41 determines at step S1 that either the outside automatic operation switch 21 or the inside automatic operation switch 22 was operated, the automatic operation mode is selected so as to implement steps S3 to S17. In specific, at step S3, the driving force to drive the door driving motor 31 is controlled to the first torque value. At step S4, the electromagnetic clutch 33 is operated so as to generate the clutch output at the first output value. As a result, an opening operation, or a closing operation, of the swing door 11 is commenced. In succession, at step S5, the CPU 41 obtains a pulse signal from the pulse sensor 36. At step S6, the CPU 41 computes a door opening/closing speed N1 of the swing door 11 and a current door opening/closing position P1 of the swing door 11. This information is stored in a RAM (random access memory) incorporated in the CPU 41. During the opening/closing operation of the swing door 11, at step S7, the CUP 41 determines whether a difference between an opening/closing speed of the swing door 11 (corresponding to a previous door opening/closing speed N0), which has been stored in the RAM of the CPU 41, and the opening/closing speed of the swing door 11 (corresponding to the opening/closing speed N1), which was stored at step S6 immediately before proceeding to step S7, exceeds a predetermined deceleration rate. When the CPU 41 determines at step S7 that the difference therebetween exceeds the predetermined deceleration rate, the CPU 41 determines that the swing door 11 is being applied with an overload. In such circumstances, at step S8, the CPU 41 sends a driving signal to the motor circuit 42 for the purpose of rotating the door driving motor 31 in a reverse rotational direction, wherein the swing door 11 is rotated to a predetermined door position. At step S9, the CPU 41 determines if the swing door 11 has moved to the predetermined door position. When the CPU 41 determines at step S9 that the swing door 11 has already been positioned at the predetermined door position, the program proceeds to step S10, wherein a driving of the door driving motor 31 is discontinued, i.e., stopped. At step S11, the CPU 41 controls operation of the electromagnetic clutch 33 in such a manner that the clutch output is controlled at the second output value, wherein the swing door 11 is supportively maintained.

At step S7, when the CPU 41 determines that the difference therebetween does not exceed the predetermined deceleration rate, the CPU 41 determines that the swing door 11 is not being applied with an overload. In such circumstances, at steps S12 and S13, the opening/closing operation of the swing door 11 is continued until the CPU 41 determines on the basis of the door opening/closing position P1 computed at step S6 that the swing door 11 is positioned at the fully open state or at the fully closed state. At step S12, when the CPU 41 determines that the swing door 11 is at the fully open state, the program proceeds to step S14, wherein a driving of the door driving motor 31 is discontinued, i.e., stopped. At step S15, the CPU 41 controls operation of the electromagnetic clutch 33 in such a manner that the clutch output is controlled at the second output value wherein the swing door 11 is held. At step S13, when the CPU 41 determines that the swing door 11 is at the fully closed state, the program proceeds to step S16, wherein a driving of the door driving motor 31 is discontinued, i.e., stopped. At step S17, the CPU 41 discontinues, i.e., stops, the operation of the electromagnetic clutch 31.

When the CPU 41 determines at step S2 that either the inside manual opening operation switch 26 or the inside manual closing operation switch 27 is being operated, the manual operation mode is selected so as to implement steps S18 to S25. In specific, at step S18, the CPU 41 determines whether or not an overload was detected during the last automatic operation mode. At step S18, when the CPU 41 determines that an overload was detected during the last automatic operation mode, the program proceeds to step S19, wherein the CPU 41 controls the driving motor to generate a driving force at the maximum level (a second torque value or the fourth torque value). At step S20, the CPU 41 controls operation of the electromagnetic clutch 33 to generate a clutch output at the maximum level, wherein an opening operation, or a closing operation, of the swing door 11 is commenced.

When the CPU 41 determines at step S18 that an overload was not detected during the last automatic operation mode, the program proceeds to step S21, wherein the CPU 41 drives the door driving motor 31 to generate a driving force at the third torque value. At step S22, the CPU 41 controls the operation of the electromagnetic clutch 33 to generate a clutch output at the maximum level, wherein an opening operation, or a closing operation, of the swing door 11 is commenced. If an operation, of the inside manual opening operation switch 26, or of the inside manual closing operation switch 27 is discontinued, i.e., stopped, during the opening/closing operation of the swing door 11, at step S23, the CPU 41 determines whether or not a manual operation signal is being inputted. When a negative answer No is obtained at step S23, the program proceeds to step S24, wherein a driving of the door driving motor 31 is discontinued, i.e., stopped. At step S25, the CPU 41 controls the electromagnetic clutch 33 to generate a clutch output at the second output value, wherein the swing door 11 is held. When an affirmative answer Yes is obtained at step S23, i.e., unless an operation, of the inside manual opening operation switch 26, or of the inside manual closing operation switch 27, is discontinued, i.e., stopped, the program returns to step S18, and the above described routine is repeated.

As described above, according to the embodiment of the present invention, because the third torque value, or the fourth torque value, of the door driving motor 31 for the duration of the manual operation mode is higher than the first torque value of the door driving motor 31 for the duration of the automatic operation mode, even if, for the duration of the automatic operation mode, an overload is imposed on the swing door 11 and a driving of the door driving motor 31 is stopped, an opening/closing operation of the swing door 11, which is implemented by a driving force of the door driving motor 31, is able to be assured while the manual operation mode is being selected. Therefore, comparing with a conventional work, it is possible to enhance convenience for opening and closing the swing door 11.

Further, according to the embodiment of the present invention, because it is possible to detect the presence or absence of an overload being applied to the swing door 11 for the duration of the automatic operation mode, it is possible to assure safety for opening and closing the swing door 11. For the duration of the manual operation mode, as far as an operation, of the manual opening operation switch 26, or of the manual closing operation switch 27 is discontinued or stopped, an opening/closing operation of the swing door 11 is discontinued, thereby enabling to assure safety.

According to the embodiment of the present invention, when the presence of an overload was detected during the automatic operation mode, the door driving motor 31 is controlled to generate a driving force at the fourth torque value. On the other hand, when the absence of an overload was detected during the automatic operation mode, the door driving motor 31 is controlled to generate a driving force at the third torque value. However, a driving force from the door driving motor 31 is not necessarily controlled between the third and fourth torque value as described above. In this case, the driving output (the second torque value) of the door driving motor 31 is designed to be equivalent to the fourth torque value, which is the maximum driving output value of the door driving motor 31.

As described above, according to the embodiment of the present invention, the first torque value during the automatic operation mode corresponds to a first driving output value, while the second torque value during the manual operation mode corresponds to a second driving output value. Here, the second driving output value is designed to be equal to, or greater than, the first driving output value. When the pulse sensor 36 (the detecting means) does not detect an overload during the manual operation mode, the second torque value is controlled at the third torque value. On the other hand, when the pulse sensor 36 (the detecting means) detects an overload during the manual operation mode, the second torque value is controlled at the fourth torque value. Here, the third torque value corresponds to a third driving output value, while the fourth torque value corresponds to a fourth driving output value. The third driving output value is designed to be equal to, or greater than the first driving output value. The fourth driving output value is designed to be greater than the third driving output value. In this case, it is preferable that the fourth driving output value is the maximum driving output value that the door driving motor 31 (the driving power source) is capable of outputting.

According to the embodiment of the present invention, the vehicle door opening and closing apparatus 12 acts to rotate the swing door 11 by use of a driving force of the door driving motor 31. However, this apparatus can act to slidably move a slide door by use of a driving force of the door driving motor 31. Without mentioning, it is obvious that an opening/closing operation of the vehicle door includes a rotation of the swing door 11, a slide movement of the slide door, and so on.

According to the embodiment of the present invention, because the second driving output value, which the driving power source outputs during the manual operation mode, is higher than the first driving output value during the automatic operation mode, even if a driving of the driving power source is discontinued, i.e., stopped, during the automatic operation mode due to detection of an overload being applied to the vehicle door, it is possible to implement, during the manual operation mode, an opening/closing operation of the vehicle door which is performed by driving the driving power source. Therefore, comparing with a conventional work, it is possible to enhance convenience for opening and closing the vehicle door. Further, according to the embodiment of the present invention, because it is possible to detect the presence or absence of an overload being applied to the swing door 11 for the duration of the automatic operation mode, it is possible to assure safety for opening and closing the swing door 11.

The principles, the preferred embodiment and mode of operation of the present invention have been described in the foregoing specification. However, the invention, which is intended to be protected, is not to be construed as limited to the particular embodiment disclosed. Further, the embodiment described herein are to be regarded as illustrative rather than restrictive. Variations and changes may be made by others, and equivalents employed, without departing from the spirit of the present invention. Accordingly, it is expressly intended that all such variations, changes and equivalents that fall within the spirit and scope of the present invention as defined in the claims, be embraced thereby.

The invention claimed is:

1. A vehicle door opening and closing apparatus comprising:

a driving power source configured to generate a driving force relevant to an opening operation, and a closing operation, of a vehicle door;

an opening-closing mechanism capable of implementing the opening operation, and the closing operation, of the vehicle door by the driving force of the driving power source;

first operating means for continuously outputting a manual operation signal, confined to times when the first operating means is continuously being operated;

second operating means for outputting an automatic operation signal irrespective of whether or not the second operating means is continuously operated, once the second operating means is put into operation; and controlling means for controlling, on the basis of the manual operation signal and the automatic operation signal, a driving of the driving power source, the controlling means being capable of switching control for driving the driving power source in such a manner that an automatic operation mode is selected at a time that the automatic operation signal is inputted to the controlling means, the automatic operation mode in which the driving power source is driven to output a predetermined first driving output value, and a manual operation mode is selected at a time that the manual operation signal is inputted to the controlling means, the manual operation mode in which the driving power source is driven to output a second driving output value which is higher than the first driving output value;

detecting means for outputting a signal representing an operating state of the vehicle door, wherein the controlling means computes, on the basis of the signal from the detecting means, an opening speed, and a closing speed, of the vehicle door, the controlling means implements a discontinuation control during the automatic operation mode, the discontinuation control by which the driving of the driving power source is discontinued at an event that the opening speed, or the closing speed, of the vehicle door is decelerated beyond a predetermined speed value, and the controlling means prohibits the discontinuation control for the duration of the manual operation mode; and wherein the controlling means implements a normal driving control by which driving of the driving power source is controlled in such a manner that the driving power source outputs a third driving output value during the manual operation mode prior to implementing the discontinuation control, and implements an urgent driving control by which driving of the driving power source is controlled in such a manner that the driving power source outputs a fourth driving output value, which is higher than the third driving output value, during the manual operation mode after implementing the discontinuation control.

2. A vehicle door opening and closing apparatus according to claim 1, wherein the first driving output value is quantitatively equivalent to the third driving output value, and the second driving output value is quantitatively equivalent to the fourth driving output value.

3. A vehicle door opening and closing apparatus according to claim 1, wherein the first driving output value is lower than the third driving output value.

4. A vehicle door opening and closing apparatus according to claim 1, wherein the operating state of the vehicle door is at least one of a position of the vehicle door to be opened and closed and opening and closing speeds of the vehicle door, and the first driving output value is predetermined in response to at least one of the position of the vehicle door to be opened and closed and the opening and closing speeds of the vehicle door.

5. A vehicle door opening and closing apparatus according to claim 1, wherein the second driving output value is determined to hold the vehicle door at a predetermined holding load, and the holding load is determined at a value that is adequate to cope with a wind blowing to the vehicle door.

6. A vehicle door opening and closing apparatus according to claim 1, wherein the second driving output value is determined to hold the vehicle door at a predetermined holding load, and the holding load is determined at a value that is adequate to cope with a load of the vehicle door which corresponds to a sloping angle of the vehicle parked on a slope.

7. A vehicle door opening and closing apparatus according to claim 1, wherein the first driving output value is lower than the fourth driving output value.

8. A vehicle door opening and closing apparatus to claim 1, wherein the fourth driving output value is a maximum value which the driving power source is capable of outputting.

9. A vehicle door opening and closing apparatus according to claim 1, wherein, when the controlling means is inputted with the automatic operation signal from the second operating means, the controlling means outputs a driving signal, which is employed to operate the vehicle door by the driving force of the driving power source, and an operation signal.

10. A vehicle door opening and closing apparatus according to claim 9, wherein the operation signal is outputted to a motor driving circuit.

11. A vehicle door opening and closing apparatus according to claim 10, wherein the motor driving circuit drives the driving power source.

12. A vehicle door opening and closing apparatus according to claim 9, wherein the operation signal is outputted to a clutch driving circuit.

13. A vehicle door opening and closing apparatus according to claim 12, wherein the clutch driving circuit operates an electromagnetic clutch.

14. A vehicle door opening and closing apparatus according to claim 9, wherein the controlling means drives the driving power source well as operating the electromagnetic clutch.

* * * * *